US005333589A

United States Patent [19]

Otsuka

[11] Patent Number: 5,333,589

[45] Date of Patent: Aug. 2, 1994

[54] APPARATUS FOR DETECTING MALFUNCTION IN EVAPORATED FUEL PURGE SYSTEM

[75] Inventor: Takayuki Otsuka, Susono, Japan

[73] Assignee: Toyota Jidosha Kabushiki Kaisha, Aichi, Japan

[21] Appl. No.: 982,280

[22] Filed: Nov. 25, 1992

Related U.S. Application Data

[63] Continuation of Ser. No. 895,102, Jun. 8, 1992, abandoned.

[30] Foreign Application Priority Data

Jun. 10, 1991 [JP] Japan ..... 3-138002

[51] Int. Cl.[5] ..... F02M 25/08; F02D 41/22

[52] U.S. Cl. ..... 123/520; 123/198 D

[58] Field of Search ..... 123/516, 518, 519, 520, 123/521, 198 D

[56] References Cited

U.S. PATENT DOCUMENTS

| | | | |
|---|---|---|---|
| 4,862,856 | 9/1989 | Yokoe et al. | 123/520 |
| 4,949,695 | 8/1990 | Uranishi et al. | 123/520 |
| 4,962,744 | 10/1990 | Uranishi et al. | 123/520 |
| 5,085,194 | 2/1992 | Kuroda et al. | 123/520 |
| 5,085,197 | 2/1992 | Mader et al. | 123/520 |
| 5,088,466 | 2/1992 | Tada | 123/520 |
| 5,099,439 | 3/1992 | Saito | 123/520 |
| 5,113,834 | 5/1992 | Aramaki | 123/520 |
| 5,143,035 | 10/1991 | Kayanuma . | |
| 5,146,902 | 9/1992 | Cook et al. | 123/520 |
| 5,158,054 | 10/1992 | Otsuka | 123/198 D |
| 5,172,672 | 12/1992 | Harada | 123/520 |
| 5,178,117 | 1/1993 | Fujimoto et al. | 123/519 |
| 5,191,870 | 3/1993 | Cook | 123/198 D |
| 5,261,379 | 11/1993 | Lipinski et al. | 123/520 |

FOREIGN PATENT DOCUMENTS

| | | |
|---|---|---|
| 4003751 | 8/1991 | Fed. Rep. of Germany . |
| 102360 | 4/1990 | Japan . |
| 130255 | 5/1990 | Japan . |
| 17169 | 2/1991 | Japan . |
| 26862 | 2/1991 | Japan . |
| WO9112426 | 8/1991 | PCT Int'l Appl. . |
| WO9116216 | 10/1991 | PCT Int'l Appl. . |

*Primary Examiner*—E. Rollins Cross
*Assistant Examiner*—Thomas N. Moulis
*Attorney, Agent, or Firm*—Kenyon & Kenyon

[57] ABSTRACT

An apparatus for detecting a malfunction in an evaporated fuel purge system, includes a diagnosis control valve provided in an air inlet passage connecting an air inlet of a canister to the atmosphere, a pressure sensor provided at an intermediate portion of a vapor passage between a fuel tank and a purge control valve for sensing a pressure in the vapor passage, and a control part for controlling opening and closing operations of both the purge control valve and the diagnosis control valve. In this apparatus, the purge control valve is opened and the diagnosis control valve is closed by the control part under a predetermined operating condition of an engine, the purge control valve being closed after the vapor passage is subjected to a negative pressure in an intake passage of the engine, the negative pressure being maintained during a predetermined time period, the apparatus thus detecting whether or not a malfunction has occurred in the system, in response to a difference between pressures sensed by the pressure sensor respectively at a beginning of the predetermined time period and at an end thereof.

8 Claims, 3 Drawing Sheets

APPARATUS FOR DETECTING MALFUNCTION IN EVAPORATED FUEL PURGE SYSTEM

This application is a continuation of application Ser. No. 07/895,102, filed on Jun. 8, 1992, now abandoned.

BACKGROUND OF THE INVENTION

1. Field of the Invention

The present invention generally relates to a malfunction detecting apparatus, and more particularly to an apparatus for detecting a malfunction in an evaporated fuel purge system in which evaporated fuel from a fuel tank is stored in a canister, and fuel vapor is fed from the canister into an intake passage of an internal combustion engine.

2. Description of the Related Art

Conventionally, in an evaporated fuel purge system, fuel evaporated in a fuel tank is fed into a canister through a vapor passage, and the fuel is stored in an adsorbent in the canister. The stored fuel is fed into an intake passage of an internal combustion engine through a purge passage. In this purge passage, a purge control valve is provided to control a flow of such fuel vapor being fed into the intake passage. In order to detect a malfunction in this evaporated fuel purge system, a malfunction detecting apparatus has been proposed by the same inventor as that of of the present invention. Such an apparatus is disclosed in the co-pending U.S. patent application Ser. No. 774,589 filed on Oct. 10, 1990. The disclosure thereof is hereby incorporated in the present specification.

In the above mentioned apparatus, a diagnosis control valve is mounted in an air inlet passage connecting the canister to the atmosphere, and a pressure sensor is mounted in this air inlet passage between the canister and the diagnosis control valve. A diagnostic process is carried out by the apparatus from a time when both the purge control valve and the diagnosis control valve are closed to a time when only the purge control valve is opened (the diagnosis control valve is still closed), so that it is detected whether or not a malfunction has occurred within the evaporated fuel purge system, in response to a difference between sensed pressures in the air inlet passage detected by the pressure sensor at the time when the purge control valve is closed and at the time when the same is opened. During the diagnostic process, the vapor passage and the fuel tank inside are subjected to vacuum pressure through the intake passage.

However, the evaporation of fuel in the fuel tank is highly active when the temperature of the fuel is high. If the vapor passage and the purge passage are closed when the fuel in the fuel tank is in such a condition, the pressures of the evaporated fuel purge system vary irregularly, so that a malfunction may incorrectly be detected due to such fluctuations in the sensed pressures. Also, the above mentioned apparatus can detect only a considerable change which has occurred in the sensed pressures, for example, a change due to separation of a connecting pipe in the vapor passage or the like. However, it is difficult to correctly detect a malfunction in response to a relatively small increase or a slight change in the pressures sensed by the pressure sensor. More particularly, there is a problem in that the above mentioned apparatus cannot correctly differentiate between a slight increase in the sensed pressures due to a small fuel leakage and a slight increase in the sensed pressures due to active fuel evaporation when the fuel in the fuel tank is at a high temperature, thus causing erroneous detection of a malfunction in the evaporated fuel purge system.

SUMMARY OF THE INVENTION

Accordingly, it is a general object of the present invention to provide an improved malfunction detecting apparatus in which the above described problems are eliminated.

Another and more specific object of the present invention is to provide a malfunction detecting apparatus which can correctly detect not only a considerable fuel leakage but also a slight fuel leakage within an evaporated fuel purge system including a fuel tank, a vapor passage, a canister and a purge passage. The above mentioned object of the present invention is achieved by a malfunction detecting apparatus provided in an evaporated fuel purge system, which apparatus includes a diagnosis control valve provided in an air inlet passage connecting an air inlet of a canister to the atmosphere, a pressure sensor provided at an intermediate portion of a vapor passage between a fuel tank and a purge control valve for sensing a pressure in the vapor passage, and a control part for controlling opening and closing operations of both the purge control valve and the diagnosis control valve. In this apparatus, the purge control valve is opened and the diagnosis control valve is closed by the control part, the purge control valve being closed by the control part after the system including the vapor passage is subjected to a negative pressure in an intake passage of an engine, the negative pressure being maintained during a predetermined time period, the apparatus thus detecting whether or not a malfunction has occurred in the system, in response to a difference between pressures sensed by the pressure sensor respectively at a beginning of the predetermined time period and at an end thereof. According to the present invention, it is possible to reliably and correctly detect not only a considerable fuel leakage but also a slight fuel leakage which may occur in the evaporated fuel purge system. A malfunction can be detected by the present invention anywhere in the evaporated fuel purge system, including the fuel tank, the vapor passage, the canister and the purge passage, when there is a small change in the pressures sensed by the pressure sensor, and therefore the malfunction detecting apparatus of the present invention is very useful for practical applications.

Other objects and further features of the present invention will become more apparent from the following detailed description when read in conjunction with the accompanying drawings.

DESCRIPTION OF THE PREFERRED EMBODIMENT

Figure 1:
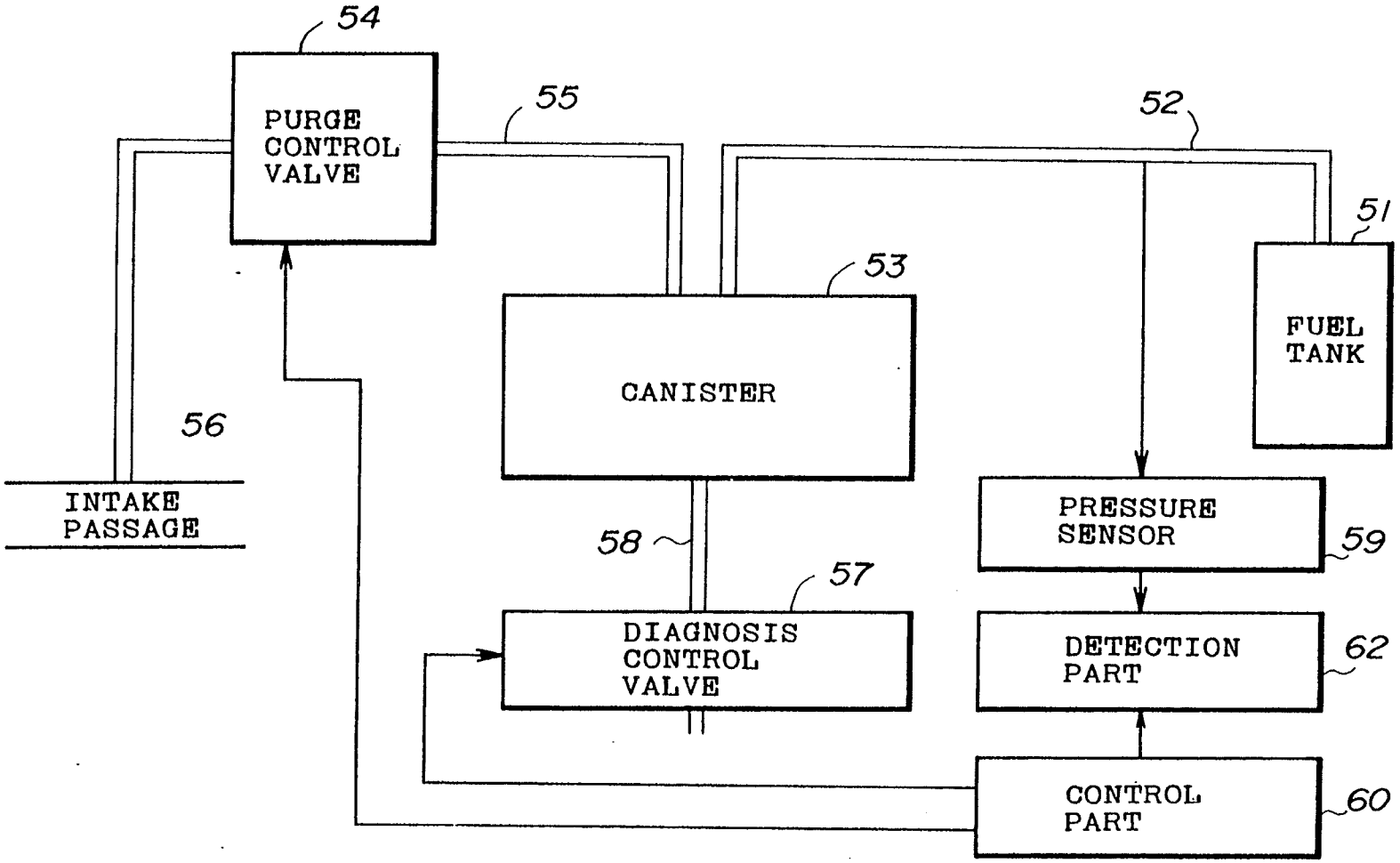
FIG. 1 is a block diagram showing a malfunction detecting apparatus of the present invention.

A description will now be given of a malfunction detecting apparatus of the present invention, with reference to FIG. 1. In FIG. 1, fuel vapor evaporated from a fuel tank 51 is fed into a canister 53 via a vapor passage 52. The canister 53 absorbs fuel vapor evaporated in the fuel tank 51 and fed to the canister 53 through the vapor passage 52. A purge passage 55 connects the canister 53 to an intake passage 56 of an internal combustion engine. A purge control valve 54 is provided at an intermediate portion of the purge passage 56 between the canister 53 and the intake passage 56, the purge control valve 54 being opened when the engine is operating under a predetermined operating condition, whereby fuel vapor is fed from the canister 53 to the intake passage 56 via the purge passage 55. A malfunction detecting apparatus of the present invention includes a diagnosis control valve 57 provided in an air inlet passage 58 connecting an air inlet of the canister 53 to the atmosphere, a pressure sensor 59 provided at an intermediate portion of the vapor passage 52 between the fuel tank 51 and the canister 53 for sensing a pressure in the vapor passage 52, a detection part 62 for detecting whether or not a malfunction has occurred in the system, in response to a difference between pressures sensed by the pressure sensor 59 respectively at a beginning of a prescribed time period and at an end thereof, and a control part 60 for controlling opening and closing operations of both the purge control valve 54 and the diagnosis control valve 57. In the malfunction detecting apparatus, the purge control valve 54 is opened and the diagnosis control valve 57 is closed by the control part 60 when the engine is operating under a predetermined operating condition, the purge control valve 54 being closed by the control part 60 after the system including the vapor passage 52 is subjected to a negative pressure in the intake passage 56, the negative pressure being maintained during a predetermined time period, and the detection part 62 detecting whether or not a malfunction has occurred in the system, in response to a difference between pressures sensed by the pressure sensor 59 respectively at the beginning of the predetermined time period and at the end thereof. According to the present invention, it is possible to reliably and correctly detect not only a considerably great fuel leakage but also a small fuel leakage in the evaporated fuel purge system.

Figure 2:
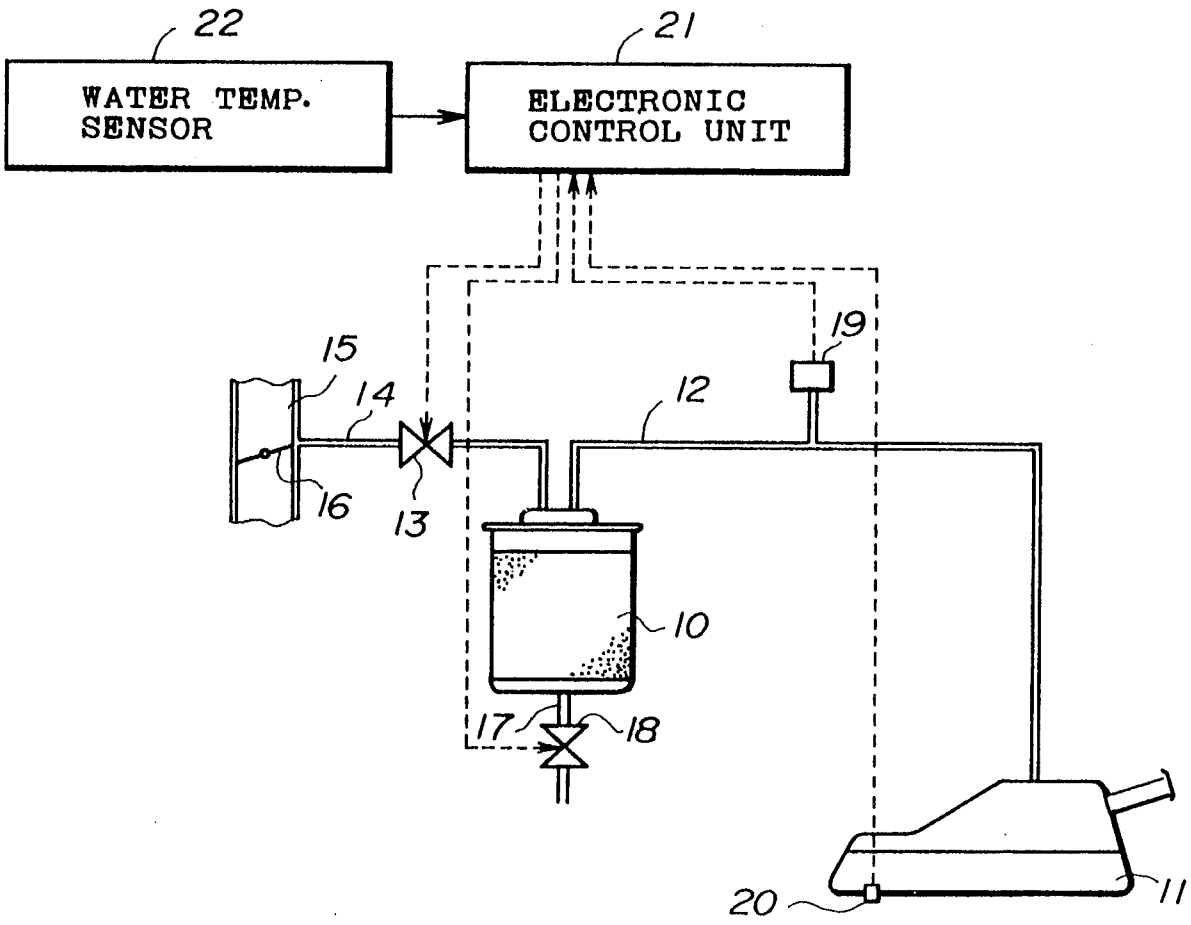
FIG. 2 is a view showing an evaporated fuel purge system to which the present invention is applied.

Next, a description will be given of an evaporated fuel purge system to which the present invention is applied, with reference to FIG. 2. In FIG. 2, a canister 10 containing an adsorbent is connected to a top surface of a fuel tank 11 via a vapor passage 12. Fuel vapor evaporated in the fuel tank 11 is fed into the canister 10 through the vapor passage 12 so that the fuel vapor is stored in the adsorbent in the canister 10. The canister 10 is also connected to an intake passage 15 via a purge passage 14 so that the stored fuel vapor is fed into the intake passage 15. A throttle valve 16 is provided within the intake passage 15 for controlling a flow of an air-fuel mixture being fed into a combustion chamber of an internal combustion engine (not shown). The purge passage 14 is connected to the intake passage 15 at a position immediately upstream of an end portion of the throttle valve 16, which is set at a fully closed position. At an intermediate portion of the purge passage 14, a purge control valve 13 is provided for controlling a flow of fuel vapor from the canister 10 being fed into the intake passage 15. This purge control valve 13 is, for example, a vacuum switching valve (VSV) which is switched ON and OFF by an electric signal being applied. When an electric signal is applied to switch ON the valve, the VSV 13 is then opened. When an electric signal is applied to switch OFF the valve, the VSV 13 is then closed. The canister 10 has an air inlet at the bottom thereof which is connected to the atmosphere via an air inlet passage 17. At an end portion of the air inlet passage 17, a diagnosis control valve 18 is provided. This diagnosis control valve 18 is, for example, the above mentioned vacuum switching valve (VSV).

A pressure sensor 19 is provided at an intermediate portion of the vapor passage 12 for sensing a pressure in the vapor passage 12. A fuel temperature sensor 20 is provided in the fuel tank 11 for sensing a temperature of fuel within the fuel tank 11. A water temperature sensor 22 is provided in the internal combustion engine for sensing a temperature of cooling water in the engine. The respective signals output by the pressure sensor 19, the fuel temperature sensor 20 and the water temperature sensor 22 are input to an electronic control unit (ECU) 21. In response to the signals received from these sensors, the ECU 21 outputs control signals respectively to the purge control valve 13 and the diagnosis control valve 18 for controlling valve opening and closing operations of the valves 13 and 18. A diagnostic process of the present invention for detecting a malfunction in the above described evaporated fuel purge system is carried out by the ECU 21.

Figure 3:
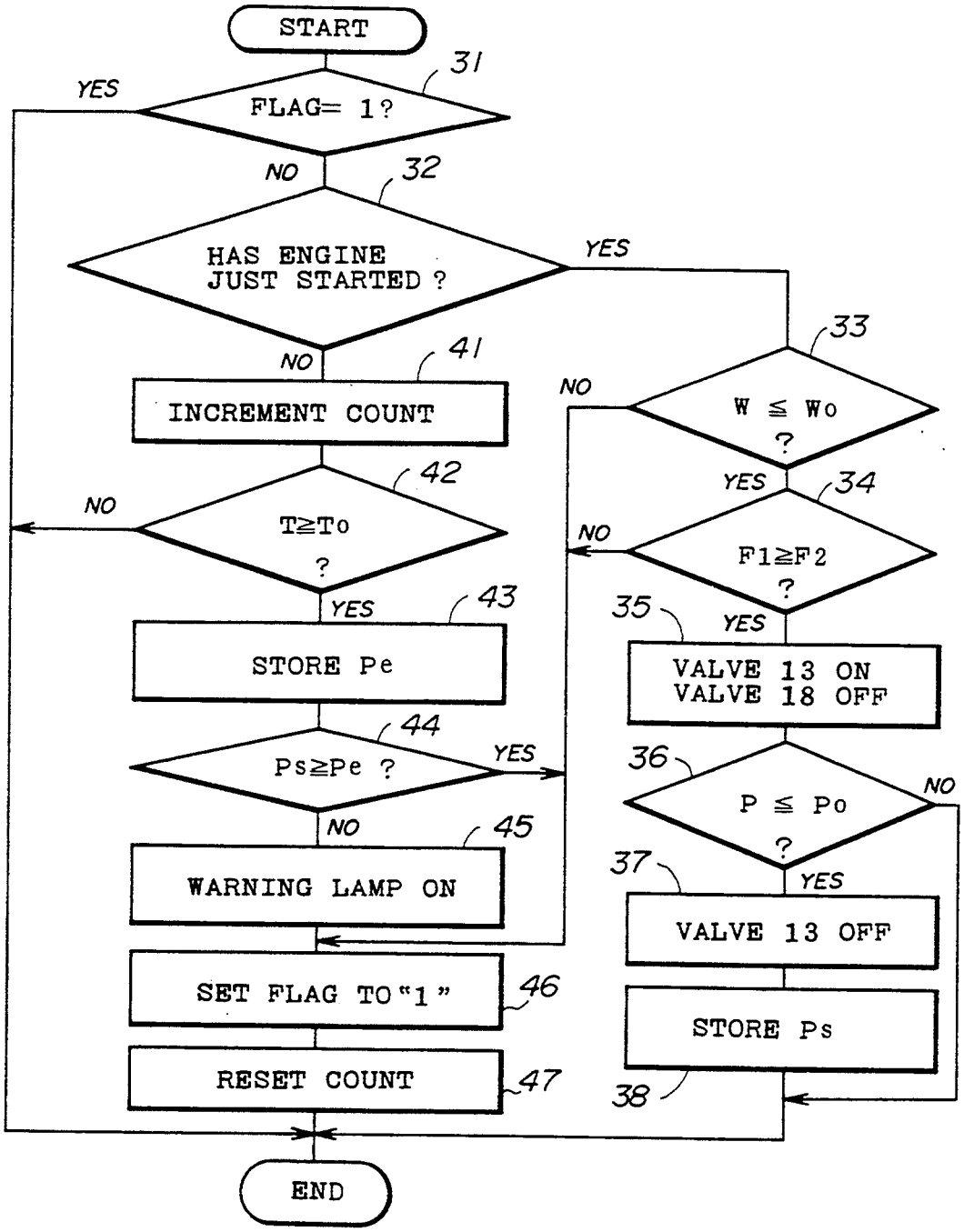
FIG. 3 is a flow chart for explaining a diagnostic process performed by the malfunction detecting apparatus of the present invention.

Next, a description will be given of the diagnostic process performed by the malfunction detecting apparatus of the present invention, with reference to FIG. 3. This diagnostic process is a subroutine which is executed within a main routine, and it is executed repeatedly at given time intervals. In the flow chart shown in FIG. 3, step 31 checks whether or not an execution flag is equal to 1. When the engine has started operating, this execution flag is always reset to zero. Thus, if the flag is not equal to 1, the engine is in an operating condition. Then, step 32 detects whether or not the engine has just started operating. It should be noted that the diagnostic process of the invention is performed immediately after the engine has started operating. The engine in this condition is still not warmed up, and the internal pressure of the fuel tank 11 does not considerably change. When the engine stops operating during a prescribed time period, the ambient temperature around the fuel tank 11 exhibits no considerable change and the temperature of fuel in the fuel tank 11 is not greatly increased. However, when the engine is continuously in an operating condition, the temperature of fuel in the fuel tank 11 is normally increased due to the heat of fuel returned to the fuel tank and due to the heat of exhaust gas from the engine, thus changing considerably the internal pressure of the fuel tank 11. Such a change in the internal pressure of the fuel tank is detrimental to detection of a malfunction in the system.

If it is detected in step 32 that the engine has just started operating, step 33 detects whether or not a sensed temperature W of cooling water in the engine indicated by a signal output by the water temperature sensor 22 is lower than a prescribed reference temperature Wo (in deg. C). When the engine stops operating for a sufficiently long period of time, the temperature of the cooling water is usually below the reference temperature Wo. If the sensed temperature W is higher than the reference temperature Wo ($W > Wo$), the operating condition of the engine in such a case is not suitable for correctly detecting a malfunction. Then, step 46 sets the execution flag to 1, step 47 resets a count to zero, and the diagnostic process ends.

If it is detected in step 33 that the sensed temperature W of the cooling water is below the reference temperature Wo (W≦Wo), step 34 detects whether or not a sensed temperature F1 of fuel in the fuel tank 11 when the engine stops operating is higher than a sensed temperature F2 of the fuel when the engine has started operating. These temperatures F1 and F2 are indicated by signals output by the fuel temperature sensor 20. If the temperature F1 is lower than the temperature F2 (F1<F2), there is a possibility that the ambient temperature around the fuel tank is increasing. Then, the above steps 46 and 47 are performed, and the process ends. In the above described embodiment of the malfunction detecting apparatus, the diagnostic process is not performed when the engine is warmed up or when the ambient temperature is too high. If the diagnostic process is performed under such circumstances, a malfunction in the system may incorrectly be detected due to a considerable change in the internal pressure of the fuel tank.

If it is detected in step 34 that the temperature F1 is higher than the temperature F2 (F1≧F2), the temperature of the fuel is not increasing so there is no considerable change in the internal pressure of the fuel tank. Then, the ECU 21 switches the purge control valve (VSV) 13 ON and switches the diagnosis control valve (VSV) 18 OFF in step 35. The purge passage 14, the canister 10, the vapor passage 12 and the fuel tank 11 are communicated with the intake passage 15 and subjected to vacuum pressure in the intake passage 15. Generally, an intake pressure in the intake passage 15 varies depending on a valve opening position of the throttle valve 16. The intake pressure in the intake passage 15 is not always within a given range of vacuum pressures below the atmospheric pressure. Thus, step 36 detects whether or not a sensed pressure P indicated by a signal output by the pressure sensor 19 is below a prescribed vacuum pressure Po.

If the sensed pressure P is higher than the prescribed vacuum pressure Po (P>Po), the intake pressure P of the intake passage 15 may be slightly below the atmospheric pressure. This condition is not suitable for correctly detecting a malfunction. In such a case, the valve 13 is not switched OFF, the valve 13 remains open and the diagnostic process ends. If the sensed pressure P is not higher than the prescribed pressure Po, the intake pressure of the intake passage 15 is still higher than the atmospheric pressure. In this case, the ECU 21 switches the valve 13 OFF (the valve 13 is closed) in step 37. Such a vacuum pressure P within the system including the canister 10, the vapor passage 12 and the fuel tank 11 is maintained. Then, step 38 stores a sensed pressure Ps indicated by a signal output by the pressure sensor 19 in a memory of the ECU 21, immediately after the valve 13 is switched OFF, and the diagnostic process ends. In the step 36, even if the sensed pressure P is higher than the prescribed vacuum pressure Po, the execution flag is not set to 1 because the water temperature and fuel temperature conditions in steps 33 and 34 are satisfied (W<Wo and F1≧F2).

If it is detected in step 32 that the engine has not started operating, step 41 increments a count by the value one. The count incremented in step 41 represents the elapsed time T (in seconds) since the valve 13 is switched OFF. Step 42 detects whether or not a predetermined time period To (in seconds) has elapsed since the valve 13 is switched OFF, by comparing the value of the count in step 41 (the elapsed time T) with the predetermined time period To. If the prescribed time period To has not yet been reached (T<To), the diagnostic process ends. If the prescribed time period To has been reached (T≧To), step 43 stores, in the memory of the ECU 21, a sensed pressure Pe indicated by a signal output by the pressure sensor 19 at the end of the prescribed time period To.

Step 44 detects whether or not the pressure Ps sensed at the beginning of the time period To is higher than the pressure Pe sensed at the end of the time period To. If the pressure Ps is higher than the pressure Pe (Ps≧Pc), it is judged that the pressure in the evaporated fuel purge system is not increasing. The ECU 21 therefore determines that the evaporated fuel purge system is normally operating and no malfunction has occurred. The steps 46 and 47 are then performed, that is, the execution flag is set to 1 and the count is reset to zero, and the diagnostic process ends. Conversely, if the pressure Ps is not higher than the pressure Pe (Ps<Pe), it is judged that the pressure in the evaporated fuel purge system is increasing. The ECU 21 then determines that a malfunction such as fuel leakage has occurred in the evaporated fuel purge system. The ECU 21 then switches a warning lamp ON in step 45 to notify a vehicle driver of the malfunction in the evaporated fuel purge system. The steps 46 and 47 are then performed, and the diagnostic process ends.

In the above described embodiment, the diagnostic process is performed when the engine has just started operating and the temperature of the cooling water in the engine is below the prescribed temperature Wo. In other words, the process for detecting a malfunction in the system is performed only when the temperature of fuel in the fuel tank is not increasing and no considerable increase in the internal pressure of the fuel tank has occurred. However, the present invention is not limited to this embodiment, as the diagnostic process may be performed also under conditions different from those described above.

During the diagnostic process, the valve 13 is opened and the valve 18 is closed, so that the system including the canister 10, the purge passage 13, the vapor passage 12 and the fuel tank 11 is open to the intake passage 15, and the system is subjected to a negative pressure, or a vacuum pressure, in the intake passage 15. At the beginning of the prescribed time period To, the valve is closed and a pressure Ps sensed by the pressure sensor 19 is then stored in the memory of the ECU 21. The vacuum pressure is maintained in the evaporated fuel purge system continuously for the prescribed time period To. At the end of the prescribed time period To, a pressure Pe sensed by the pressure sensor 19 is stored in the memory of the ECU 21. Then, the ECU 21 detects whether or not a malfunction has occurred in the system, by comparing the stored pressure Ps with the stored pressure Pe. In other words, it is detected whether or not a malfunction has occurred in the evaporated fuel purge system in response to a difference between the sensed pressures supplied by the pressure sensor 19.

According to the present invention, it is also possible that, when a difference between the pressures Ps and Pe sensed by the pressure sensor 19 respectively at the beginning of the predetermined time period To and at the end thereof is greater than a prescribed pressure difference value (or, a prescribed detection criterion), the ECU 21 determines that a malfunction has occurred in the evaporated fuel purge system. It is also possible that, when the pressures Ps and Pe sensed by the pressure sensor 19 have a transition rate greater than a prescribed transition rate value, the ECU 21 determines that a malfunction has occurred in the system.

Since the difference between the sensed pressures sensed by the pressure sensor 19, the amount of pressure change of the sensed pressures, and the rate of pressure change of the sensed pressures can be easily and accurately detected, it is possible to correctly detect not only a considerably great fuel leakage but also a small fuel leakage in the evaporated fuel purge system. A malfunction can be detected by the above described apparatus in the fuel tank 11, the vapor passage 12, the canister 10 and the purge passage 14. It is possible to correctly detect a malfunction even in response to a slight change in the sensed pressures by the pressure sensor, and therefore the apparatus is useful for practical applications.

Further, the present invention is not limited to the above described embodiments, and variations and modifications may be made without departing from the scope of the present invention.

What is claimed is:

1. An apparatus for detecting a malfunction in an evaporated fuel purge system, said evaporated fuel purge system including a canister for absorbing fuel vapor fed from a fuel tank to the canister via a vapor passage, a purge passage for connecting the canister to an intake passage of an engine, and a purge control valve provided in the purge passage, said purge control valve being opened when the engine is operating under a predetermined operating condition, whereby fuel vapor is fed from the canister to the intake passage via the purge passage, said apparatus comprising:

first means for subjecting said system to a negative pressure in the intake passage by opening the purge control valve thereby connecting the canister to the intake passage via the purge passage, and for subsequently closing the purge control valve to maintain said negative pressure in said system for a predetermined time period by disconnecting the purge passage from the intake passage and disconnecting the canister from the atmosphere during the predetermined time period, pressure sensing means for sensing a pressure in said system independently of the operation of said first means; and discrimination means for detecting whether or not a malfunction has occurred in said system, in response to a difference between pressures sensed by said pressure sensing means respectively at a beginning of said predetermined time period and at an end thereof.

2. An apparatus according to claim 1, wherein said first means includes a diagnosis control valve provided in an air inlet passage connecting an air inlet of said canister to the atmosphere.

3. An apparatus according to claim 2, wherein said first means closes said diagnosis control valve and opens said purge control valve so that said system is subjected to said negative pressure of the intake passage, and wherein said first means closes said purge control valve when a pressure in said system reaches a prescribed negative pressure through said subjecting of said system to said negative pressure.

4. An apparatus according to claim 1, wherein said discrimination means determines that a malfunction has occurred in said system when it is detected that a first pressure sensed by said pressure sensing means at the beginning of the predetermined time period is not higher than a second pressure sensed by said pressure sensing means at the end thereof.

5. An apparatus according to claim 1, wherein said discrimination means determines that a malfunction has occurred in said system when a difference between pressures sensed by said pressure sensing means respectively at a beginning of said predetermined time period and at an end thereof is greater than a predetermined value.

6. An apparatus according to claim 1, wherein said discrimination means determines that a malfunction has occurred in said system when a transition rate derived from said pressures sensed by said pressure sensing means during said predetermined time period is greater than a predetermined value.

7. An apparatus according to claim 1, further comprising second sensing means for sensing an operating condition of the engine immediately after the engine has started operating, wherein said discrimination means functions to detect whether or not a malfunction has occurred in said system, when an operating condition of the engine sensed by said second sensing means is a prescribed low-temperature condition.

8. An apparatus according to claim 7, wherein said second sensing means includes a fuel temperature sensor provided in said fuel tank to sense a temperature of fuel of the fuel tank, a memory for storing a temperature of the fuel sensed by said fuel temperature sensor when the engine stops operating, and means for determining that the engine is in the prescribed low-temperature operating condition, if a fuel temperature sensed by said fuel temperature sensor immediately after the engine has started operating is lower than a temperature of the fuel stored in said memory.

* * * * *

UNITED STATES PATENT AND TRADEMARK OFFICE

CERTIFICATE OF CORRECTION

PATENT NO. : 5,333,589

DATED : August 2, 1994

INVENTOR(S) : Takayuki OTSUKA

It is certified that error appears in the above-indentified patent and that said Letters Patent is hereby corrected as shown below:

Column 6, line 9, change "$Pe(Ps \geq Pc)$," to --$Pe(Ps \geq Pe)$,--.

Signed and Sealed this

Fifth Day of September, 1995

*Attest:*

Bruce Lehman

BRUCE LEHMAN

*Attesting Officer*

*Commissioner of Patents and Trademarks*